US007883435B2

(12) United States Patent
Sullivan

(10) Patent No.: US 7,883,435 B2
(45) Date of Patent: Feb. 8, 2011

(54) TUNABLE BROADHEAD

(76) Inventor: Kevin Michael Sullivan, 633 Ramey Rd., Lakemont, GA (US) 30552

( * ) Notice: Subject to any disclaimer, the term of this patent is extended or adjusted under 35 U.S.C. 154(b) by 542 days.

(21) Appl. No.: 11/939,770

(22) Filed: Nov. 14, 2007

(65) Prior Publication Data

US 2009/0124439 A1 May 14, 2009

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS 4,781,386 A 11/1988 Armitage
5,482,294 A 1/1996 Sullivan et al.
5,494,298 A * 2/1996 Maleski ..... 473/584
7,232,390 B2 * 6/2007 Mizek et al. ..... 473/583
7,338,397 B2 * 3/2008 Mizek et al. ..... 473/583

* cited by examiner

*Primary Examiner*—John Ricci
(74) *Attorney, Agent, or Firm*—Akerman Senterfitt; Michael K. Dixon

(57) ABSTRACT

A tunable broadhead is disclosed for rotating an elongated body of a broadhead relative to an extension member. The tunable broadhead enables the blades of a broadhead to be rotated relative to an arrow shaft into which the tunable broadhead may be attached to tune arrow flight from a bow. In particular, the tunable broadhead may include an extension member rotatably attached to a generally elongated broadhead body, wherein the extension member may be releasably affixed in position with a releasable locking device so that the broadhead may be tuned by rotating the broadhead relative to an arrow and locking the broadhead in position.

20 Claims, 4 Drawing Sheets

TUNABLE BROADHEAD

FIELD OF THE INVENTION

This invention is directed generally to broadheads, and more particularly to broadheads capable of being tuned.

BACKGROUND

Modern broadheads are tips attachable to a distal end of an arrow shaft and include one or more blades having cutting arrises. The blades extend outwardly from a generally cylindrical broadhead body. The blades typically extend from the broadhead such that the cutting arris of each blade are at an acute angle relative to a longitudinal axis of the broadhead body and extend from a distal point at an intersection at an outer surface of the broadhead body to near the tip at an outer surface of the broadhead body to a proximal point radially outward of the outer surface of the broadhead body. In this position, the blades are capable of cutting flesh as the broadhead passes through an animal.

Modern compound bows can propel arrows at speeds of greater than 300 feet per second. Accurate arrow flight at such speeds is typically only accomplished when all components of the bow and arrow system are tuned properly. For instance, cam timing, cam and wheel alignment, rest position, arrow nock position, fletching clearance, arrow weight consistency, arrow spline consistency, broadhead configuration, and broadhead alignment are all factors that can each greatly affect accuracy. Broadheads have always proved challenging to tune. A longitudinal axis of a broadhead must be aligned with a longitudinal axis of the arrowshaft. Otherwise, the blades can act as airfoils and cause the arrows to plane, which severely affects accuracy.

Broadheads often need to be aligned relative to the arrowshaft to insure adequate clearance of the broadhead past the arrow shelf of a bow. In addition, the blades of a broadhead often need to be aligned with the fletching of an arrow and relative to the bow riser. In particular, in connection with broadheads having two bladed designs, it is often desirable to align the blades of the broadhead such that the blades are generally aligned with the riser of the bow. Sometimes, the blades may need to be aligned differently to create the most consistent arrow flight, which is often determined through repeated use.

Broadheads are commonly attached to arrows through use of a threaded insert glued into the end of a hollow aluminum or carbon arrow. Broadheads typically include a threaded post sized to be inserted into the insert and tightened down with a broadhead wrench. Once the broadhead is tightened into position, the alignment of the blades of the broadhead is examined. The alignment of the blades may be changed in aluminum arrows by heating the insert to loosen or melt the glue so that the insert may be rotated within the aluminum shaft. Carbon arrows may not be heated because the heat can easily damage the carbon fibers. While heating the arrows enables the inserts to be rotatable within the arrow shaft, repeated heating typically reduces the strength of the glues and often creates poor connections between the inserts and the arrows.

SUMMARY OF THE INVENTION

This invention relates to a tunable broadhead attachable to an arrow shaft. The broadhead may be secured to an arrow shaft such that the broadhead may be adjustable about a longitudinal axis relative to the arrow shaft. The broadhead may be rotatable about the longitudinal axis such that blades extending outwardly may be moved into different positions relative to the arrow shaft to tune arrow flight. A releasable locking device may be affixed to prevent the broadhead from rotating relative to the arrow shaft to keep the blades in a desired orientation. Configuring the broadhead in this manner enables alignment of the blades to be adjustable relative to the arrow shaft. Thus, the alignment of the blades extending from the broadhead may be adjusted to increase consistency of arrow flight from a bow.

The tunable broadhead includes a generally elongated broadhead body having a proximal portion configured to be attached to a shaft and a tip at a distal portion that is configured to facilitate penetration of the tip into an object. A plurality of blades may be separated circumferentially from each other about a longitudinal axis of the generally elongated broadhead body and may extend outwardly from the generally elongated broadhead body. The generally elongated broadhead body may include a bore that extends from a proximal end of the generally elongated broadhead body into the generally elongated broadhead body and may be aligned with the longitudinal axis. An extension member may have a distal portion positioned within the bore and a proximal portion extending along the longitudinal axis away from the generally elongated broadhead body, wherein the extension member may be rotatable within the bore. The distal portion of the extension member may be threaded, and the bore may be threaded such that the extension member may be releasably attached to the generally elongated broadhead body. The proximal portion of the extension member may also be threaded for attachment to an arrow shaft. The threads on the distal portion may be sized with a different pitch than the threads on the proximal portion. Such a configuration enables the orientation of the blades to be changed.

A releasable locking device may be included and may be configured to releasably affix the extension member relative to the generally elongated broadhead body to prevent the generally elongated broadhead body from being rotated relative to the extension member. In one embodiment, the releasable locking device may include a threaded set screw threadably attached to a threaded orifice in the generally elongated broadhead body. The threaded orifice may extend radially inward through the generally elongated broadhead body. The threaded orifice may be positioned aft of the plurality of blades. In other embodiments, the releasable locking device may be a chemical applied to the distal portion of the extension member, a nylon threadlocker material, or other appropriate device.

An advantage of this invention is that the blades may be oriented in any position independent of the orientation of the insert within an end of the arrow shaft. Thus, the blades may be oriented in any positioned about a longitudinal axis of the arrow shaft to improve clearance and accuracy. For instance, the blades of three blade embodiments may be aligned with the fletching on the arrow. In other embodiments, such as two blade embodiments, the blades may be aligned to reduce planing upon the broadhead leaving the bow during the initial moments of the shot.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
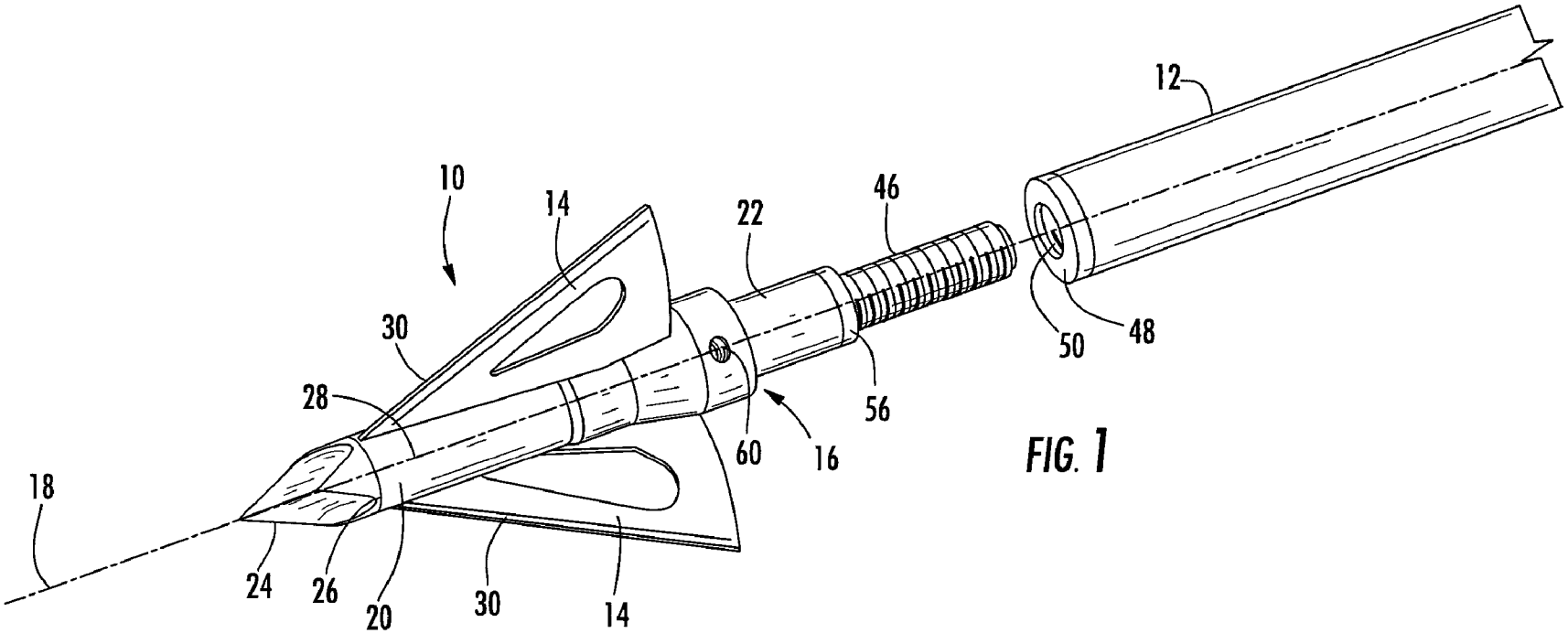
FIG. 1 is a perspective view of a broadhead of the invention.

As shown in FIGS. 1-4, this invention is directed to a tunable broadhead 10 attachable to an arrow shaft 12. The broadhead 10 may be secured to an arrow shaft 12 such that the broadhead 10 may be adjustable about a longitudinal axis 18 relative to the arrow shaft 12. In particular, the broadhead 10 may be rotatable about the longitudinal axis 18 such that blades 14 extending outwardly may be moved into different positions relative to the arrow shaft 12 to tune arrow flight. A releasable locking device 16 may be affixed to prevent the broadhead 10 from rotating relative to the arrow shaft 12 to keep the blades 14 in a desired orientation. Configuring the broadhead 10 in this manner enables alignment of the blades 14 to be adjustable relative to the arrow shaft 12. Thus, the alignment of the blades 14 extending from the broadhead 10 may be adjusted to increase consistency of arrow flight from a bow.

As shown in FIG. 1, the broadhead 10 may be formed from a generally elongated broadhead body 20 having a proximal portion 22 configured to be attached to a shaft 12 and a tip 24 at a distal portion 26 that is configured to facilitate penetration of the tip 24 into an object. The elongated broadhead body 20 may have an outer surface 28 generally configured to match a diameter of the arrow shaft 12, however, the outer surface 28 need not be identical to the arrow shaft 12. The elongated broadhead body 20 may be generally cylindrical. In other embodiments, the elongated broadhead body 20 may have longitudinal flutes in the outer surface 28 or other elements forming noncylindrical cross-sections. The tip 24 may be attachable to the elongated broadhead body 20 or may be formed integrally with the elongated broadhead body 20. The tip may be any appropriate configuration, including, but not limited to, a trocar tip or a cut on contact tip formed from one or more permanent or replaceable razor blades.

Figure 2:
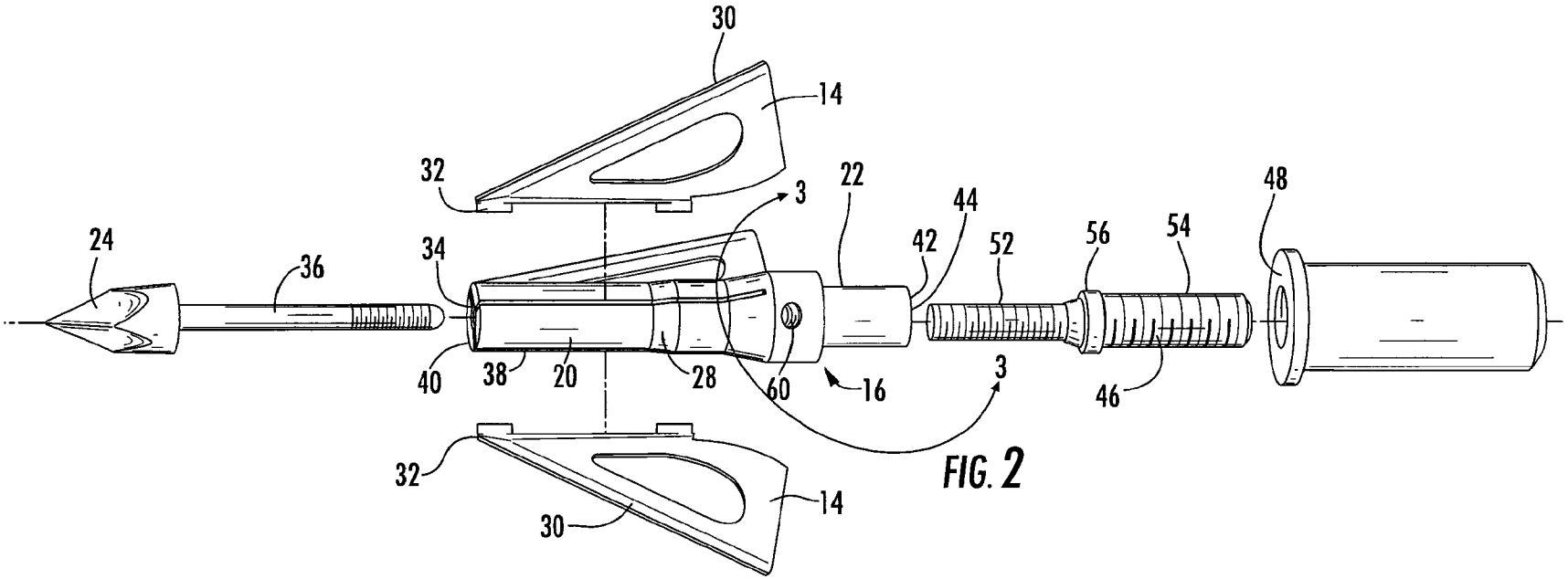
FIG. 2 is an exploded perspective view of the broadhead of this invention.

As shown in FIGS. 1 and 2, a plurality of blades 14 may extend outwardly out of the elongated broadhead body 20. In some embodiments, the blades 14 may extend radially outward aligned with axes extending radially outward. In other embodiments, the blades 14 may extend generally outwardly and include radial and tangential components in the position of the blade 14. In some embodiments, the blades 14 may extend radially outward and in other embodiments, the blades 14 may extend at an angle to a radial axis. The blades 14 may number one, two, three, four, five or more. The blades 14 may or may not be positioned equidistant from each other. The blades 14 may include a cutting arris 30 positioned at an acute angle relative to the longitudinal axis 18 such that a distal end 32 of the cutting arris 30 intersects with the outer surface 28 of the elongated broadhead body 20 and a proximal end 34 of the cutting arris 30 is positioned radially outward from the outer surface 28. The blades 14 may be formed integrally with the elongated broadhead body 20 or may be removably attached to the elongated broadhead body 20.

In one embodiment, the blades 14 may be removably attached to the elongated broadhead body 20. The blades 14, tip 24 and elongated broadhead body 20 may be configured and attached to the elongated broadhead body 20 as set forth in U.S. Pat. No. 5,482,294, which is incorporated by reference herein in its entirety. In particular, the blades 14 may include a flange 32 that facilitate removable attachment of the blades 14 within a central chamber 34 of the elongated broadhead body 20. The blades 14 may extend outwardly through a plurality of slots 38 positioned in the elongated broadhead body 20. The tip 24 may include a distally extending shaft 36 configured to be releasably attached within the central chamber 34 to force the flange 32 of the blades 14 radially outward against the wall forming the central chamber 34. The tip 24 may be threadably attached within the central chamber 34. The tip 34 may also prevent the blades 14 from being removed through a distal opening 40 in the central chamber 34.

Figure 3:
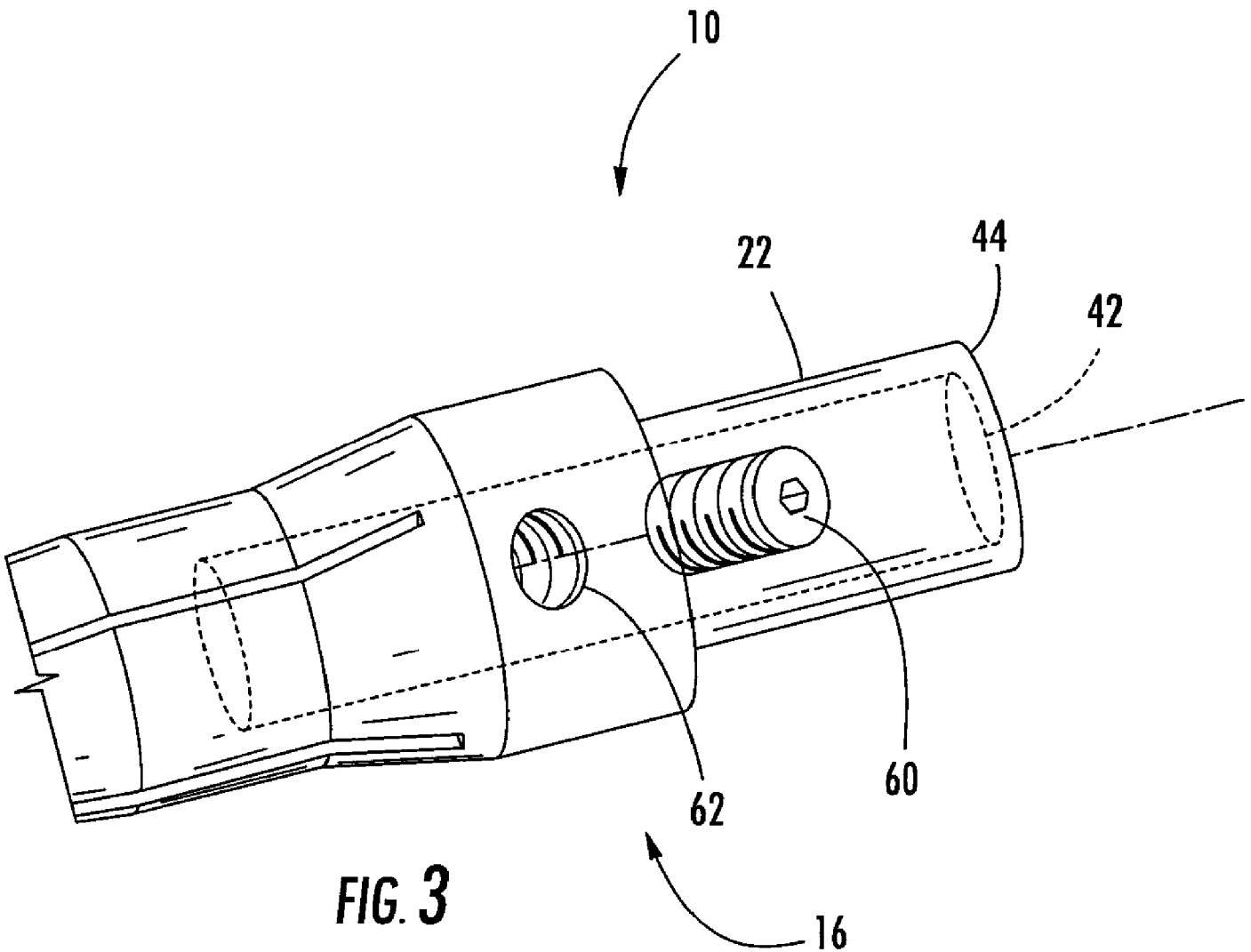
FIG. 3 is a detail view of the releasable locking device of the invention at detail 3-3 of FIG. 2.

As shown in FIGS. 2 and 3, a bore 42 may extend from a proximal end 44 of the generally elongated broadhead body 20 into the generally elongated broadhead body 20 and be aligned with the longitudinal axis 18. The bore 42 may be configured to releasably receive an extension member 46. In one embodiment, the bore 42 may include threads for releasably engaging the extension member 46.

Figure 4:
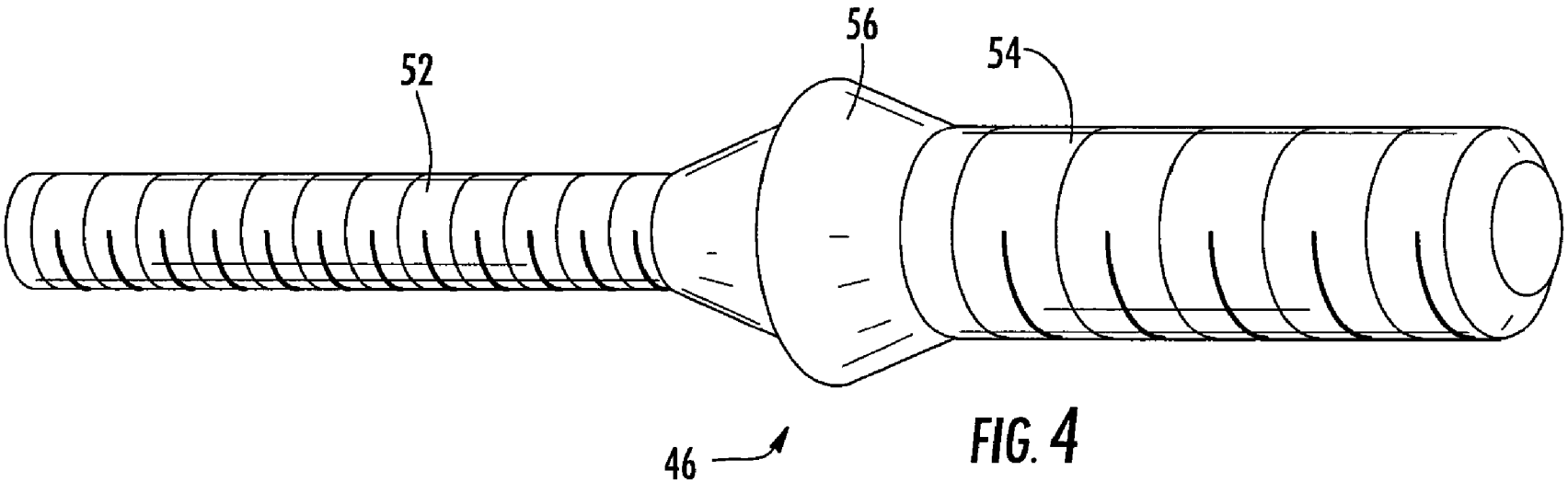
FIG. 4 is a detail view of the extension member of the invention.

As shown in FIGS. 1 and 4, the broadhead 10 may include the extension member 46 configured to attach the broadhead 10 to the arrow shaft 12. In one embodiment, the arrow shaft 12 may include a common insert 48 positioned within a proximal end of the arrow shaft 12. The insert 48 may include a threaded cavity 50. The extension member 46 may be formed from a distal portion 52 that is configured to be positioned within the bore 42 and a proximal portion 54 extending along the longitudinal axis 18 away from the generally elongated broadhead body 20 and receivable within the insert 48. The proximal portion 54 may be releasably attached to the insert 48. In one embodiment, the proximal portion 54 may be threaded and configured to be removably attachable to the insert 48. The distal portion 52 may be configured to be inserted into the bore 42. The distal portion 52 may include threads configured to mate with threads in the bore 42 so that the extension member 46 may be rotatable relative to the proximal portion 54 of the extension member 46. The extension member 46 may include a flange 56 separating the distal portion 52 from the proximal portion 54. The cross-sectional size of the distal portion 52 and proximal portion 54 may differ, as shown in FIGS. 2 and 4, or be the same. The proximal portion 22 of the generally elongated broadhead body 20 may have an outer diameter that is smaller than remaining portions of the generally elongated broadhead body 20 and sized to be received within the insert 48 to increase the strength of the connection between the broadhead 10 and the arrow shaft 12. In one embodiment, the distal portion 52 of the extension member 46 may extend distally of the proximal portion 22 of the generally elongated broadhead body 20.

The threads on the distal portion 52 may be sized with a different pitch than the threads on the proximal portion 22. Such a configuration enables the orientation of the blades to be changed. Otherwise, if the thread pitch of the distal portion 52 were equivalent to the thread pitch of the proximal portion 22, then orientation of the blades would not change even though the extension member 46 had been moved. In particular, the distal portion 52 may be rotated to move the distal portion 52. Because the threads of the distal portion 52 are pitched differently than the proximal portion 22, the broadhead body 20 may rotate a different amount before contacting the insert 48, thereby creating a different alignment for the blades 14 relative to the arrow 12. In one embodiment, the threads on the distal portion 52 may be about 48 threads per inch with a size 4 (4-48), and the threads on the proximal portion 22 may be about 32 threads per inch with a size 8 (8-32), which create approximately a 3 to 1 ratio. When the distal portion 52 is rotated about one full rotation, the orientation of the blades 14 may be changed about 120 degrees. The configuration of the extension member 46 is not limited to this particular configuration but may also have alternative configurations as well.

The releasable locking device 16 may be configured to releasably affix the extension member 46 relative to the generally elongated broadhead body 20 to prevent the generally elongated broadhead body 20 from being rotated relative to the extension member 46 once positioned as desired. When unlocked, the releasable locking device 16 permits the blades 14 of the broadhead 10 to be aligned as desired even after the broadhead 10 has been attached to the arrow shaft 12 by attaching the proximal portion 54 of the extension member 46 in the insert 48 of the arrow shaft 12. The releasable locking device 16 may be formed from any device capable of releasably securing the generally elongated broadhead body 20 to the extension member 46. In one embodiment, as shown in FIGS. 1-3, the releasable locking device 16 may be formed from a threaded set screw 60 inserted into an orifice 62 within the generally elongated broadhead body 20. The orifice 62 may extend radially inward from the outer surface 28 and into the central chamber 42 so that the set screw 60 may contact the extension member 46. The orifice 62 may be positioned anywhere along the length of the generally elongated broadhead body 20 so long as the set screw 60 can contact the extension member 46. In one embodiment, as shown in FIGS. 1-3, the releasable locking device 16 may be positioned aft of the blades 14. The releasable locking device 16 may also be configured such that the set screw 60 may extend radially inward aligned with radial and tangential components, thereby placing the set screw 60 at a nonorthogonal angle relative to the longitudinal axis 18. The set screw 60 may be of sufficient length to be threadable attached within the orifice 62 and be placed into contact with the extension member 46, yet not extend radially outward from the outer surface 28 so as to not create aerodynamic drag or friction when the broadhead 10 pierces an object, such as an animal.

In another embodiment, the releasably locking device 16 may be a chemical capable of increasing friction between the threads of the distal portion 52 and the bore 42. The chemical may be any appropriate chemical capable of increasing the resistance to the extension member 46 rotating relative to the bore 42. The releasably locking device 16 may also be a nylon threadlocker material or another appropriate material capable of increasing the resistance to the extension member 46 rotating relative to the bore 42.

During use, the broadhead 10 may be fully assembled with blades 14 intact. In embodiments in which the blades 14 are separate components, the blades 14 may be attached to the broadhead 10 and secured thereto. If the releasable locking device 16 is not already tightened, it should be tightened to securely engage the extension member 46. The broadhead 10 may then be attached to the arrow shaft 12. In one embodiment, the proximal portion 54 that extends uncovered from the generally elongated broadhead body 20 may be inserted into the insert 48 and rotated to mesh the threads of the proximal portion 54 to the threads of the insert 48. The generally elongated broadhead body 20 may be rotated until the generally elongated broadhead body 20 is securely attached to the arrow shaft 12.

The alignment of the blades 14 with the arrow 12 may be checked. If the alignment of the blades 14 is determined to be misaligned, the broadhead 10 may be removed from the insert 48. The releasable locking device 16 may then be released, thereby permitting the broadhead body 20 to rotate relative to the extension member 46. By rotating the generally elongated broadhead body 20, the orientation of the blades 12 collectively may be changed relative to the arrow shaft 12. Once the generally elongated broadhead body 20 has been properly aligned, the releasable locking device 16 may be moved to securely engage the extension member 46. In one embodiment, a wrench, such as an alien wrench or other appropriate wrench, may be used to rotate the releasable locking device 16, such as the set screw 60, to tighten the releasable locking device 16 against the extension member 46. The broadhead body 20 may then be reattached to the arrow 12. The broadhead body 20 may be tightened against the arrow 12 and when the broadhead body 20 is tightened against the arrow 12, the orientation of the blades 14 relative to the arrow 12 is different. Thus, the tunable broadhead 10 is configured such that the orientation of the blades 14 is adjustable. In particular, the blades 12 may be aligned with the fletching of the arrow shaft 12, aligned relative to the nock and thereby aligned relative to the bow from which the arrow shaft 12 will be shot, or aligned in another appropriate alignment.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A tunable broadhead, comprising:

a generally elongated broadhead body having a proximal portion configured to be attached to a shaft and a tip at a distal portion that is configured to facilitate penetration of the tip into an object;

a plurality of blades separated circumferentially from each other about a longitudinal axis of the generally elongated broadhead body and extending outwardly from the generally elongated broadhead body;

wherein the generally elongated broadhead body includes a bore that extends from a proximal end of the generally elongated broadhead body into the generally elongated broadhead body and is aligned with the longitudinal axis;

an extension member having a distal portion positioned within the bore and a proximal portion extending along the longitudinal axis away from the generally elongated broadhead body, wherein the extension member is rotatable within the bore;

a releasable locking device configured to releasably affix the extension member relative to the generally elongated broadhead body to prevent the generally elongated broadhead body from being rotated relative to the extension member; and wherein the releasable locking device comprises a threaded set screw threadably attached to a threaded orifice in the generally elongated broadhead body.

2. The tunable broadhead of claim 1, wherein the threaded orifice extends radially inward through the generally elongated broadhead body.

3. The tunable broadhead of claim 1, wherein the threaded orifice is positioned aft of the plurality of blades.

4. The tunable broadhead of claim 1, wherein the distal portion of the extension member is threaded, and the bore is threaded such that the extension member may be releasably attached to the generally elongated broadhead body.

5. The tunable broadhead of claim 4, wherein the proximal portion of the extension member is threaded such that a thread pitch of the distal portion differs from a thread pitch of the proximal portion.

6. The tunable broadhead of claim 1, wherein the releasable locking device further comprises a chemical.

7. The tunable broadhead of claim 1, wherein the releasable locking device further comprises a nylon threadlocker material.

8. A tunable broadhead, comprising:

a generally elongated broadhead body having a proximal portion configured to be attached to a shaft and a tip at a distal portion that is configured to facilitate penetration of the tip into an object;

a plurality of blades separated circumferentially from each other about a longitudinal axis of the generally elongated broadhead body and extending outwardly from the generally elongated broadhead body;

wherein the generally elongated broadhead body includes a bore that extends from a proximal end of the generally elongated broadhead body into the generally elongated broadhead body and is aligned with the longitudinal axis;

an extension member having a distal portion positioned within the bore and a proximal portion extending along the longitudinal axis away from the generally elongated broadhead body, wherein the extension member is rotatable within the bore;

a releasable locking device configured to releasably affix the extension member relative to the generally elongated broadhead body to prevent the generally elongated broadhead body from being rotated relative to the extension member; and wherein the distal portion of the extension member is threaded, and the bore is threaded such that the extension member may be releasably attached to the generally elongated broadhead body.

9. The tunable broadhead of claim 8, wherein the proximal portion of the extension member is threaded such that a thread pitch of the distal portion differs from a thread pitch of the proximal portion.

10. The tunable broadhead of claim 8, wherein the releasable locking device comprises a threaded set screw threadably attached to a threaded orifice in the generally elongated broadhead body, wherein the threaded orifice extends radially inward through the generally elongated broadhead body.

11. The tunable broadhead of claim 8, wherein the releasable locking device further comprises a chemical.

12. The tunable broadhead of claim 8, wherein the releasable locking device further comprises a nylon threadlocker material.

13. A tunable broadhead, comprising:

a generally elongated broadhead body having a proximal portion configured to be attached to a shaft and a tip at a distal portion that is configured to facilitate penetration of the tip into an object;

a plurality of blades separated circumferentially from each other about a longitudinal axis of the generally elongated broadhead body and extending outwardly from the generally elongated broadhead body;

wherein the generally elongated broadhead body includes a bore that extends from a proximal end of the generally elongated broadhead body into the generally elongated broadhead body and is aligned with the longitudinal axis;

an extension member having a distal portion positioned within the bore and a proximal portion extending along the longitudinal axis away from the generally elongated broadhead body, wherein the extension member is rotatable within the bore;

a releasable locking device configured to releasably affix the extension member relative to the generally elongated broadhead body to prevent the generally elongated broadhead body from being rotated relative to the extension member; and wherein the releasable locking device comprises a chemical.

14. The tunable broadhead of claim 13, wherein the releasable locking device comprises a nylon threadlocker material.

15. The tunable broadhead of claim 13, wherein the releasable locking device comprises a threaded set screw threadably attached to a threaded orifice in the generally elongated broadhead body and wherein the threaded orifice extends radially inward through the generally elongated broadhead body.

16. The tunable broadhead of claim 15, wherein the threaded orifice is positioned aft of the plurality of blades.

17. A tunable broadhead, comprising:

a generally elongated broadhead body having a generally cylindrical outer body, a proximal portion configured to be attached to a shaft and a pointed tip at a distal portion that is configured to facilitate penetration of the tip into an object;

a plurality of blades separated circumferentially from each other about a longitudinal axis of the generally elongated broadhead body and extending outwardly from the generally elongated broadhead body;

wherein the generally elongated broadhead body includes a bore that extends from a proximal end of the generally elongated broadhead body into the generally elongated broadhead body and is aligned with the longitudinal axis;

an extension member having a threaded distal portion positioned within the bore and a threaded proximal portion extending along the longitudinal axis away from the generally elongated broadhead body, wherein the extension member is threadably attached to the bore and is rotatable within the bore and wherein the proximal portion of the extension member is threaded such that a thread pitch of the distal portion differs from a thread pitch of the proximal portion;

a releasable locking device configured to releasably affix the extension member relative to the generally elongated broadhead body to prevent the generally elongated broadhead body from being rotated relative to the extension member.

18. The tunable broadhead of claim 17, wherein the releasable locking device comprises a threaded set screw threadably attached to a threaded orifice in the generally elongated broadhead body.

19. The tunable broadhead of claim 18, wherein the threaded orifice extends radially inward through the generally elongated broadhead body.

20. The tunable broadhead of claim 18, wherein the threaded orifice is positioned aft of the plurality of blades.

* * * * *